US008839910B2

(12) United States Patent
Tanaka et al.

(10) Patent No.: US 8,839,910 B2
(45) Date of Patent: Sep. 23, 2014

(54) FOOD AND DRINK CONVEYANCE DEVICE

(75) Inventors: Kunihiko Tanaka, Sakai (JP); Toshiaki Takeguchi, Tondabayashi (JP); Seiji Ataka, Wakayama (JP)

(73) Assignee: Kura Corporation Ltd., Osaka (JP)

( * ) Notice: Subject to any disclaimer, the term of this patent is extended or adjusted under 35 U.S.C. 154(b) by 994 days.

(21) Appl. No.: 12/453,858

(22) Filed: May 26, 2009

(65) Prior Publication Data

US 2009/0294217 A1 Dec. 3, 2009

(30) Foreign Application Priority Data

May 27, 2008 (JP) ..... 2008-137559

(51) Int. Cl.

| | |
|---|---|
| ***B65G 51/01*** | (2006.01) |
| ***G06Q 50/12*** | (2012.01) |
| ***A47F 10/06*** | (2006.01) |
| ***B65G 47/50*** | (2006.01) |
| ***B65B 25/00*** | (2006.01) |

(52) U.S. Cl.

CPC ..... *A47F 10/06* (2013.01); *B65B 25/001* (2013.01); *Y10S 294/901* (2013.01)

USPC ..... 186/49; 294/65.5; 294/901

(58) Field of Classification Search

USPC ..... 186/38–51; 294/65.5, 901

See application file for complete search history.

(56) References Cited

U.S. PATENT DOCUMENTS

| | | | | |
|---|---|---|---|---|
| 6,581,727 | B1 * | 6/2003 | Tokuno | 186/50 |
| 7,783,379 | B2 * | 8/2010 | Beane et al. | 700/237 |
| 2001/0006596 | A1 * | 7/2001 | Vickary | 414/543 |
| 2004/0071539 | A1 * | 4/2004 | Anater et al. | 414/793.2 |
| 2005/0193901 | A1 * | 9/2005 | Buehler | 99/468 |

FOREIGN PATENT DOCUMENTS

| | | |
|---|---|---|
| JP | 2001-299553 | 10/2001 |

* cited by examiner

*Primary Examiner* — Jeffrey Shapiro

(74) *Attorney, Agent, or Firm* — Wenderoth, Lind & Ponack, L.L.P.

(57) ABSTRACT

A food and drink conveying device used while being laid on a conveyance path of a conveying apparatus, including a plate loading portion; a detection means for detecting a plate laid on the plate loading portion; a retaining member fixed to the plate loading portion for retaining a plate cover over the plate loading portion; and a removal means for removing the plate cover retained in the retaining member to be put on a plate laid on the plate loading portion. In the food and drink conveying device, the removal means is operated at the time of the detection means detecting the plate laid on the plate loading portion so that the plate cover removed from the retaining means is to be put on the plate.

6 Claims, 7 Drawing Sheets

FOOD AND DRINK CONVEYANCE DEVICE

FIELD OF THE INVENTION

The present invention relates to a food and drink conveyance device intended for use together with a food and drink conveying apparatus which enables a series of plates dished up (filled) with food and drink (such as various sorts of sushi, other food and deserts) to be carried out on a conveyance path, and enables a guest of a restaurant to choose and take desired dishes as they pass by on the conveyance path.

BACKGROUND OF THE INVENTION

Recently, restaurants are known to have a conveying apparatus including a circulation conveyance path which is laid along the eating and drinking tables or counters etc. in the eating and drinking guest area in the restaurant. In a kitchen, a cook makes a lot of vinegared rice balls and puts a various sort of ingredient or topping on them and shapes them into sushi pieces. Thereafter, those sushi pieces are placed on the plates and then transferred on the conveyance path of the conveying apparatus so that these dishes sequentially pass by the tables or counters in the restaurant. On the other hand, a guest chooses and picks up the dishes according to one's own taste from the conveyance path. In this way, the guests could have anything they like according to their own taste.

By the way, since those sushi pieces served on the plates are circulated along the conveyance path at a predetermined rate through the conveying apparatus as described above, the sushi pieces tend to become dried and may also be touched inadvertently by any of the guests during its circulation. Accordingly, there is a need for taking effective measures to keep the served sushi pieces clean and preventing them from drying during their circulation.

Conventionally, in order to solve the problems as described above, after having the respective dishes sealed with a plate cover formed separately, these dishes are carried out on the conveyance path. See Japanese Laid-Open Patent Publication No. 2001-299553.

However, by the conventional manner as described above, there is a need for a cook holding a plate cover on each dish or plate by hand while holding the plate cover with the other hand and transferring the dish with the plate cover one by one onto the conveyance path. On the other hand, it is required of a guest to remove the dishes according to one's taste from the conveyance path and then to take off the plate cover while holding it with one's hand. Resultantly, performing these actions is bothersome as a whole.

In addition, each time the plate cover is put on or removed from the respective dishes, since a cook and a guest holds the plate cover with one hand to put it on and remove it from each dishes, the plate cover might be soiled. Further, the plate covers removed from the dishes by guests are put on the relevant table or counter so that available space on the table or counter is reduced.

The prior art document: Laid Open (Unexamined) Japanese Patent Publication No. 2001-299553

SUMMARY OF THE INVENTION

The present invention is made to solve the above-described problems, and an object of the present invention is to provide a food and drink conveying device for enabling a plate cover to be easily put on a plate and easily removed from the plate while preventing a guest (diner) and a cook from directly accessing the plate cover with their own hand.

In order to attain the object mentioned above, the present invention is directed to a food and drink conveying device which is incorporated into a conveyance path of a conveying apparatus. The food and drink conveying device comprises: a plate loading portion; a detection means for detecting a plate laid on the plate loading portion; a retaining member fixed to the plate loading portion for retaining a plate cover over the plate loading portion; and a removal means for removing the plate cover retained by the retaining member to be put on a plate laid on the plate loading portion. The removal means is operated at the time of the detection means detecting the plate laid on the plate loading portion so that the plate cover removed from the retaining means is to be put on the plate.

Further, in the food and drink conveying device according to the present invention, the retaining member includes any one of a magnet and a magnetic material, and the plate cover includes a magnetic material to be attracted by a magnetic field force of the magnet or the magnetic material of the retaining member.

Furthermore, in the food and drink conveying device according to the present invention, the detection means and the removal means are held together as a unit at the opposite ends of a connection rod being bent at each of the two corners in a shape of C whose axes are at right angles to one another but in the same plane. A rod portion at one end of the connection rod consists of the detection means being bent at a right angle to its tip which is mounted on the plate loading portion while normally extending out upwardly by virtue of a spring tension from the inner space of the plate loading portion. A rod portion at the other end of the connection rod consists of the removal means being bent at right angles to its tip which is provided while retracted inside of the removal means. The removal means is operated at the time of the detection means having depressed downwardly with a plate loaded on the plate loading portion, and the rod portion of the removal means is extended downwardly so that a plate cover held in the removal means is removed to be put on the plate.

According to the first aspect of the present invention, when a plate is loaded on the plate loading portion, the plate rod sensing portion senses the plate loading. Simultaneously, the plate remover activates to release retaining the plate cover on the plate remover so that the plate cover is automatically separated from the plate cover retaining member and dropped onto the plate loaded onto the plate loading portion. Thus, the plate cover seals the sushi pieces dished up thereon without the need for a cook and a guest directly accessing the dishes on the plate.

Further, according to another aspect of the present invention, when the plate covered with the plate cover is simply lifted from the plate loading portion manually, the plate rod sensing portion senses its removal from the plate loading portion and simultaneously activates to hold automatically the plate cover onto the plate retaining member. In this way, it is possible to easily reset the plate cover in the initial condition of retaining the plate cover onto the plate cover retaining member.

DETAILED DESCRIPTION OF THE INVENTION

Hereinafter, a food and drink conveying device according to an embodiment of the present invention will be described with reference to the drawings.

Figure 10:
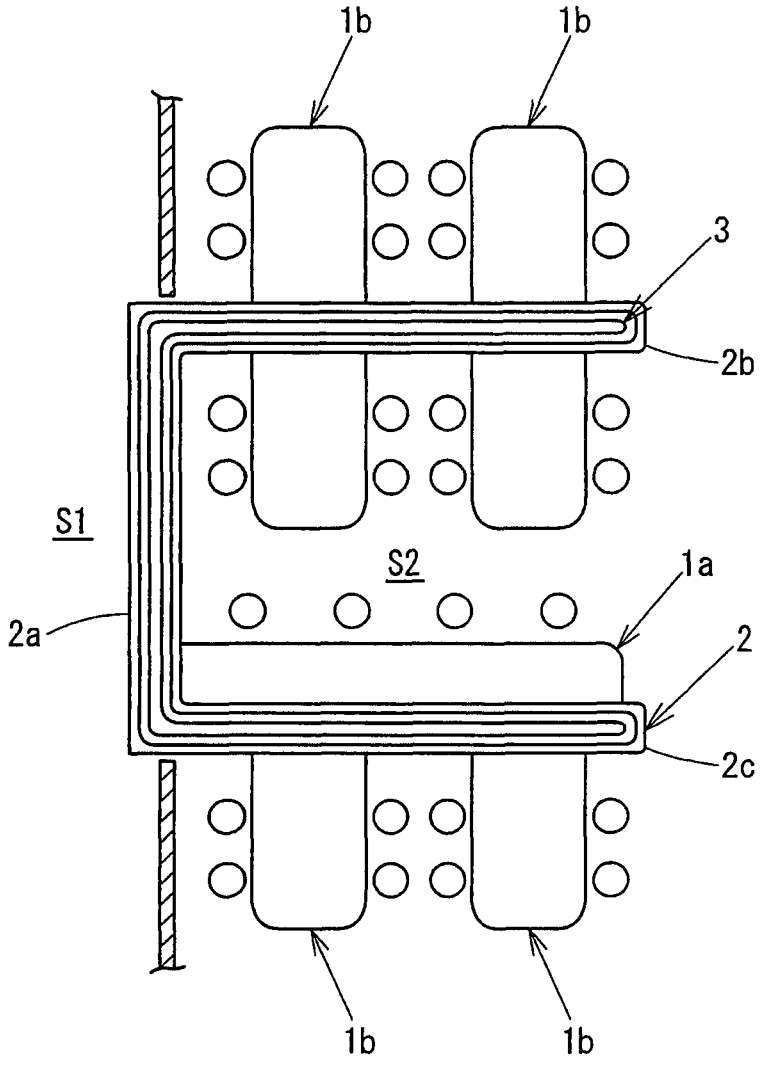
FIG. 10 is a diagram illustrating an inside of a sushi restaurant in which the food and drink conveying apparatus is provided, as viewed from the top thereof.

Initially, FIG. 10 shows an inside of a sushi restaurant as viewed from the top thereof. Provided in a hall of the sushi restaurant shown in FIG. 10 are: a counter seat 1*a* and a table seated with plural seats 1*b*, a partition housing 2 arranged in front of a kitchen room 51 and along the counter seat 1*a*, and a circulating conveyance path 3 of a conveying apparatus on which a plurality of plates 4 dished up with sushi R in the kitchen room 51 are served one by one.

Figure 11:
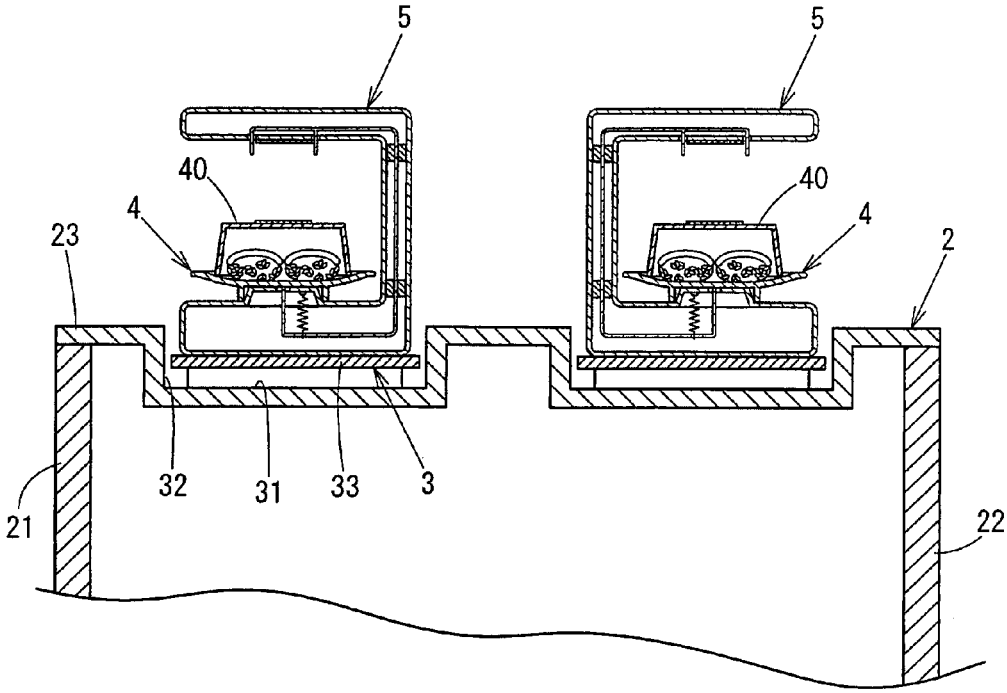
FIG. 11 is an enlarged cross-sectional view of a main portion of the food and drink conveying apparatus.

As shown in FIG. 11, the partition housing 2 is comprised of a pair of parallel side walls 21, 22 and upper wall 23 and bottom wall (not shown) connected between the upper ends and the lower ends, respectively, of the side walls 21, 22, all of which extend over the full length of the conveyance path of the conveying apparatus and are formed in a box-shaped, i.e. rectangular cross section. As shown in detail in FIG. 10, the partition housing 2 is composed of a first housing section 2*a* arranged in front of the kitchen room 51, and a second housing section 2*b* and a third housing section 2*c* extending straight in parallel with each other after turning by 90 degrees at both outside ends of the first housing section 2*a* respectively. The first housing section 2*a* separates the kitchen room 51 from the eating and drinking area of the hall of the sushi restaurant, the second housing section 2*b* partitions a rain of tables with multiple seats 1*b* inside and a train of tables with multiple seats 1*b* outside, and the third housing section 2*c* partitions a part of counter seats 1*a* inside and a train of tables with multiple seats 1*b* outside.

As shown in FIG. 11, the conveyance path 3 of the conveying apparatus is composed of a double recessed channel portion 31 configured laterally on each top wall 23 of the first, the second and the third housing sections 2*a*, 2*b*, and 2*c*. An endless flat-bar chain 33 is driven with an electric motor drive and run in the recessed channel portion 31 while being guided by the inner sidewalls thereof so that the endless flat-bar chain 33 circulates along the conveyance path.

In the conveying apparatus having the above-mentioned configuration, the required number of sushi pieces are made by a cook in the kitchen room S1 and then dished up on the corresponding number of plates. These sushi dishes R are loaded one by one onto the conveyance path in front of the kitchen room S1 whereby these dishes R are carrying out along the circulating conveyance path while passing by the counter seats 1*a* and the tables with multiple seat 1*b* arranged in the periphery of the conveyance path. Guests sitting at their counter seats 1*a* and tables 1*b* according to their own taste to have any of dishes R as they pass by on the conveyance path.

Such an ordinary plate 4 comprising of a round dish-like portion 41 in a plane view and a circular rest 42 shaped in the center of the bottom outside of the dish-like portion 41 is available for the conveying system of the instant invention.

The food and drink conveying device according to the present invention is used in combination with the conveying apparatus including the endless flat-bar chains 33 described above. The food and drink conveying device will be described in detail below.

The food and drink conveying device denoted by reference numeral 5 in FIG. 1 to FIG. 5 fundamentally includes: a plate loading portion 6 formed in a disk shape as viewed from above; a detection means 7 for detecting a plate 4 laid on the plate loading portion 6; a retaining member 8 fixed to the plate loading portion 6 for retaining (holding) a plate cover 40 over the plate loading portion 6; and a removal means 9 for removing the plate cover 40 retained in the retaining member 8 so that the cover 40 can be put on a plate 4 laid on the plate loading portion 6 when the detection means 7 detects that the plate 4 is loaded on the plate loading portion 6.

The plate cover 40 is formed of transparent synthetic resin in a cylindrical shape, and the bottom end of which is opened. In this embodiment, a thin magnetic iron plate 40*b* is fixed at the middle of the top wall 40*a* of the plate cover 40.

The plate loading portion 6 is comprised of a circular bottom plate 61 as viewed from a horizontal plane, a circular top plate 62 as viewed from a horizontal plane and a side plate 63 surrounding the peripheries of the top plate 62 and the bottom plate 61. In this manner, the carrying portion 6 can be configured to be put on the flat-bar chains 33.

The middle of the top plate 62 of the plate loading portion 6 is provided with a convex portion 64 shaped in a frustum of a cone enabling it to fit in a depression made in the rest 42 of the plate 4, whereby the plate 4 dished up with sushi pieces is easily loaded by holding it in one of the cook's hands. Further, an aperture 66 is provided in the center of a top wall 65 of the convex portion 64.

The retaining member 8 is composed of a pair of opposed plates, that is, an upper plate 81 and a lower plate 82 spaced apart from each other at a predetermined distance. A side plate 83 surrounds the peripheries of the upper plate 81 and the lower plate 82.

A plate permanent magnet 84 is fixed to the lower plate 82 of the retaining member 8 at the middle thereof. The lower plate 82 is provided with two apertures 85, 85 in each location so that a double rod removing portion 91 as detailed hereafter can be installed to have a reciprocating motion, wherein the locations are laying near the periphery of the plate permanent magnet 84.

The retaining member 8 described above is disposed at the top end of a hollow arm 67 which stands on the edge portion of the plate loading portion 6. Thus, the retaining member 8 is located at a determined distance apart from the plate loading portion 6 and laid to be vertically opposed to each other.

The hollow arm 67 is arranged between the plate loading portion 6 and the retaining member 8. The arm 67, the plate loading portion 6, and the retaining member 8 each form an internal space which are connected to each other.

The detection means 7 and the removal means 9 shown in FIG. 1 to FIG. 5 are caused to make mechanical operations.

Specifically, a connection rod 70 shaped generally in a C as viewed from the front plane which is bent at each of the three corners at a right angles comprises a rod sensing portion 71 to be retracted and extended reciprocally through aperture 66 in the convex portion 64 of the plate conveying portion 6, and a double rod removing portion 91 to be extended and retracted by reversing motion through a pair of apertures 85, 85 in the lower plate 82. The rod sensing portion 71 and the double rod removing portion 91 are installed at both ends of the connection rod 70 respectively, in which the rod sensing portion 71 is normally forced to be extended through an aperture 66 upwardly, and the double rod removing portion 91 is forced to be retracted inside of the retaining member 8 by an extension of a spring 70*a* respectively.

When the rod sensing portion 71 is depressed downward against a tension of the spring 70*a*, the double rod removing portion 91 is compelled to extend out of the respective apertures 85 of the lower plate 82.

The connection rod 70 is disposed in the inner space passing from the plate loading portion 6 through the arm 67 to the retaining member 8. The connection rod 70 reciprocates upward and downward through guide elements 68 provided in the internal space formed in the arm 67.

The food and drink conveying device 5 described above is utilized while being located on the conveyance path 3. The rod sensing portion 71 of the plate detection member 7 normally projects upward through the aperture 66 of the top wall 65 from the inner space of the plate carrying portion 6 by a force of extension spring 70*a*, while the double rod removing portion 91 of the connection rod 70 is simultaneously retracted through the aperture 85 of the lower plate 82 inside of the retaining member 8.

Figure 1:
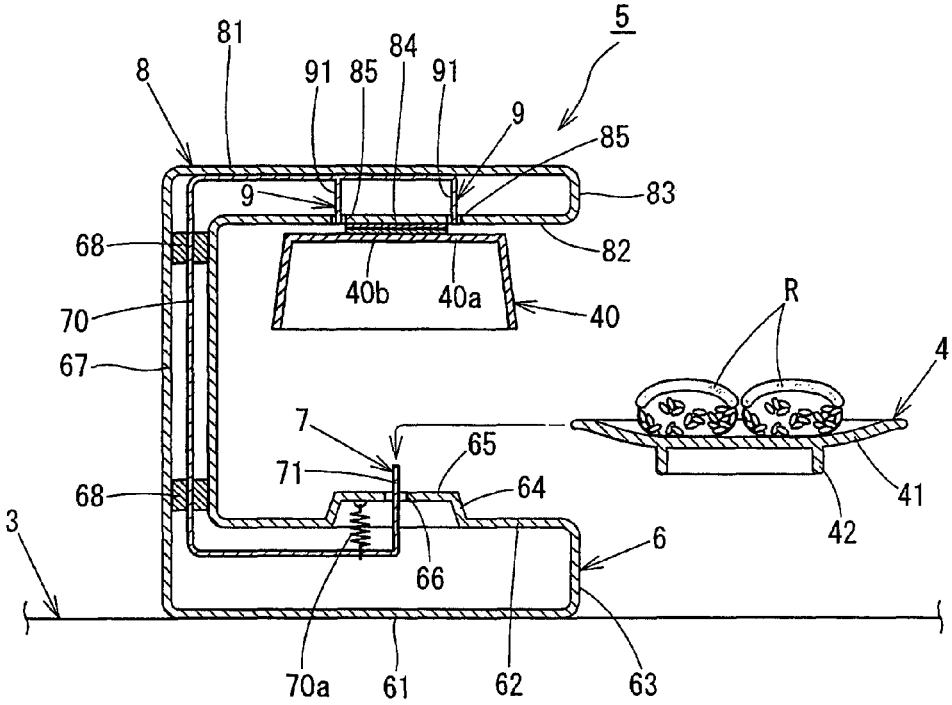
FIG. 1 is a schematic cross-sectional view of a food and drink conveying device according to an embodiment.

As shown in FIG. 1, the plate cover 40 is held on the underside of the lower plate 82 of the retaining member 8 by having the iron plate 40*b* attached to the top wall 40*a* of the plate cover 40 attracted to the magnet 84 fixed on the lower plate 82 of the retaining member 8.

Figure 2:
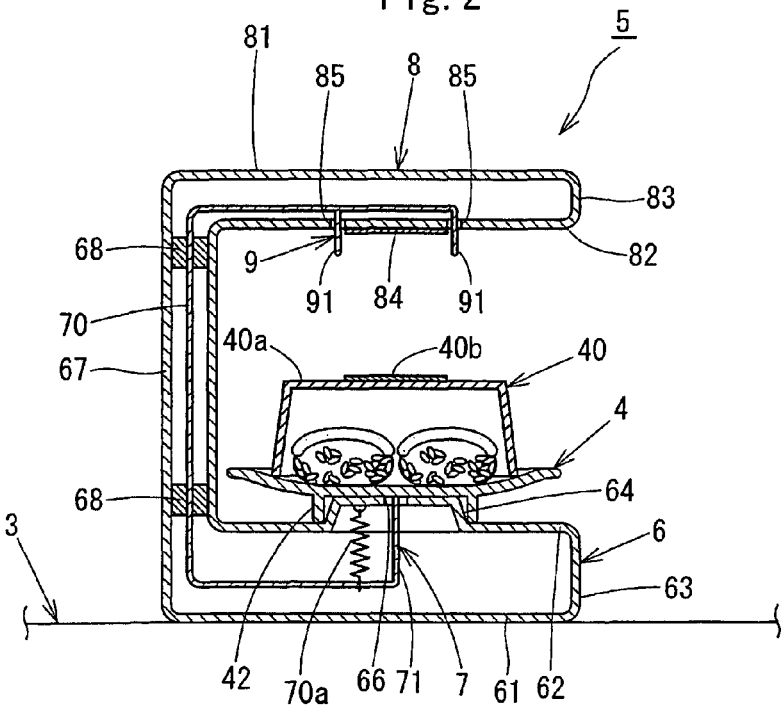
FIG. 2 is a schematic cross-sectional view of the food and drink conveying device having a plate loaded on a plate loading portion.

When the plate 4 dished up with sushi pieces R is loaded on the top plate 62 of the plate loading portion 6 with the rest 42 of it fit to the convex portion 64, the bottom of the dished plate 41 depresses the rod sensing portion 71 projecting from the convex portion 64 against the spring force exerted by the spring 70*a*. As a result, the double rod removing portions 91 extend downwardly outside of the retaining member 8 through the doubled aperture 85 to depress the top wall 40*a* of the plate cover 40 downward so that the iron plate 40*b* attracted to the magnet 84 is removed, and then the removed plate cover 40 is dropped and put on the dished plate 41 so as to cover the sushi R thereon as shown in FIG. 2.

The sushi R on the plate 41 covered by the plate cover 40 is circulated along the conveyance path 3. Since each plate 41 dished up with sushi R is conveyed while being covered over by the plate cover 40, there is no accident of an unordered guest inadvertently touching the sushi R, during the circulation of the sushi R and the problem that the sushi R on the plate 4 tends to become dried due to wind generated during the conveyance is solved.

Figure 3:
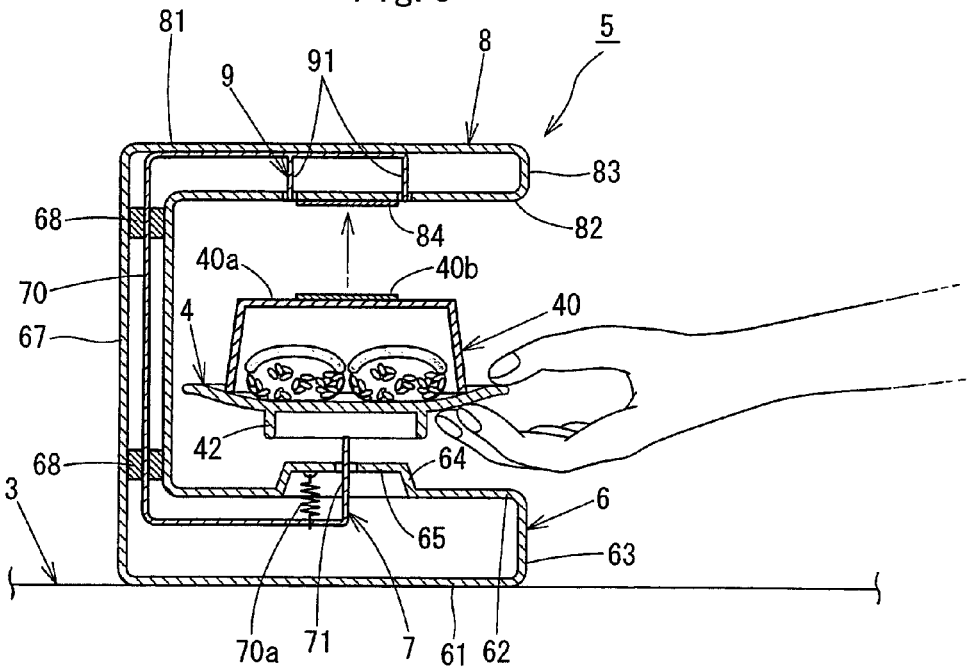
FIG. 3 is a schematic cross-sectional view of the food and drink conveying device from which a plate on the plate loading portion is being removed.
Figure 4:
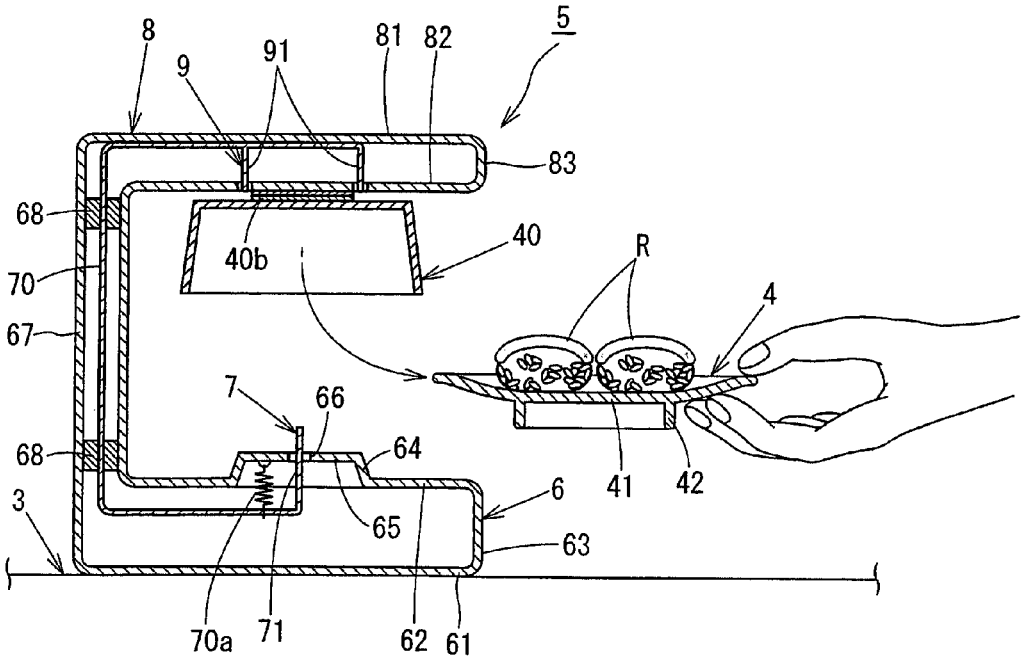
FIG. 4 is a schematic cross-sectional view of the food and drink conveying device from which the plate on the plate loading portion has been removed.
Figure 5:
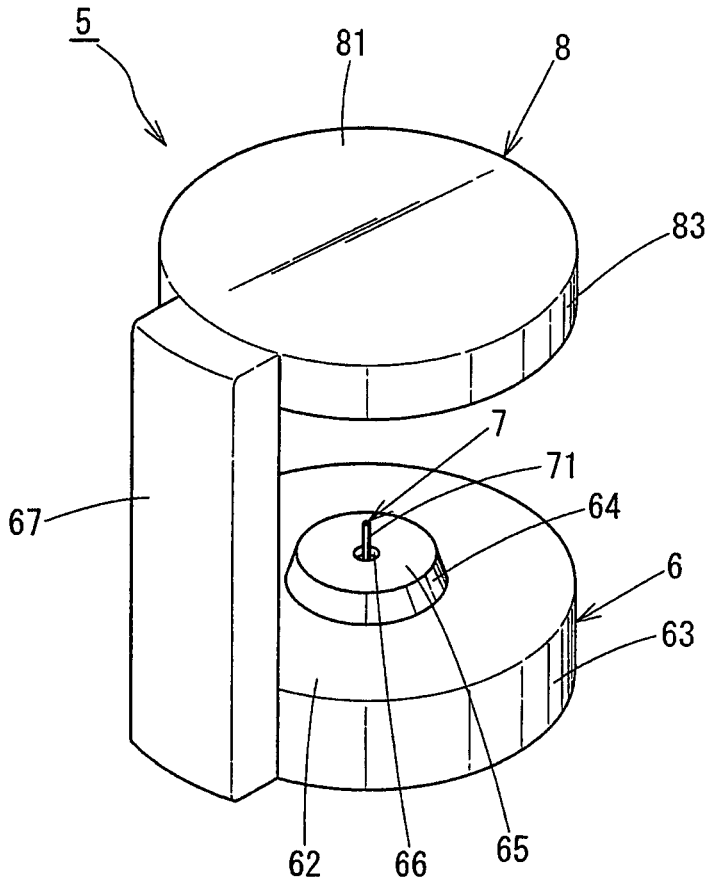
FIG. 5 is a schematic perspective view of the food and drink conveying device.

On the other hand, when a guest chooses according to their own taste and takes out the plate 4 from the food and drink conveying device 5, as shown in FIG. 3, the guest holds the edge of the dish plate 41, lifting it upward manually toward the top wall 40*a* of the plate cover 40. This allows the plate cover 40 to become attached to the bottom surface of the lower plate 82 of the retaining member 8. In this operation, upon lifting the plate 4 apart from the tip of the rod sensing portion 71, the rod sensing portion 71 extends upward through the aperture 66 of the top wall 65 from the inner space of the plate loading portion 6 with an extension force exerted by the compressed spring 70*a* due to the release of the depression force of the plate 41 laid thereon. Simultaneously, the double rod removing portion 91 is retracted into the internal space of the retaining member 8, whereby, as shown in FIG. 4, the iron plate 40*b* of the plate cover 40 is attracted and attached to the magnet 84, and the plate cover 40 is retained by the retaining member 8 so that the guest will take only the chosen plate 4 dished up with sushi R from the conveyance path.

When the food and drink conveying device 5 having the plate cover 40 retained therein is returned back to the kitchen, plates newly dished up with sushi R can be loaded onto a plate loading portion 6 of the conveying device distributed on the circulating conveyer through procedures as described above.

According to the conveying device of the present invention, not only a guest but also a cook can easily perform the process of putting a plate cover 40 on the loaded plate 4 and removing it from there without directly accessing the plate 4.

Accordingly, cleanliness of the plate cover 40 is effectively enhanced and the plate cover 40 removed from the plate 4 is not placed on a table, unlike in the conventional art.

In the embodiment described above, the iron plate 40*b* is fixed to the top wall 40*a* of the plate cover 40, and the permanent magnet 84 is fixed to the lower plate 82 of the retaining member 8 at the center thereof. However, the present invention is not limited thereto. For example, the permanent magnet 84 may be fixed to the top wall 40*a* of the plate cover 40, and the iron plate 40*b* may be fixed to the lower plate 82 of the retaining member 8. Alternatively, the permanent magnet 84 may be fixed to each of the plate cover 40 and the retaining member 8.

FIG. 6 to FIG. 9 show a food and drink conveying device according to another embodiment. In the food and drink conveying device 5 shown in FIG. 6 to FIG. 9, an electromagnet 840 is used instead of the permanent magnet 84 described above, and the detection means 7 is configured as a light-sensing device 710, and a light-sensing section 711 of the light-sensing device 710 is disposed in the aperture 66.

The removal means 9 includes a control device 910 having a microcomputer for controlling whether or not power is to be supplied to the electromagnet 840 described above.

When the light-sensing device 710 detects light, the control device 910 performs control so as to supply power to the electromagnet 840, so that the electromagnet 840 is magnetized. When the light-sensing device 710 does not detect light, the control device 910 performs control so as not to supply power to the electromagnet 840, so that the electromagnet 840 is demagnetized.

When about 0.5 to one seconds pass after the light-sensing device 710 has detected light most recently, the control device 910 performs control so as to stop supplying power to the electromagnet 840.

Further, in the embodiment described above, a timer 510 may be provided. In this case, when the light-sensing device 710 does not detect light, the control device 910 may control the timer 510 so as to be on, and when the light-sensing device 710 detects light, the control device 910 may control the timer 510 so as to be off.

The control device 910 may measure a time period during which the timer 510 is on. When the timer 510 continues to be on for a predetermined time period, for example, for twenty minutes, the control device 910 controls a warning lamp 511 provided on the top surface of the retaining member 8 so as to be lit up, and stops magnetization of the electromagnet 840 until a reset switch (not shown) is pressed even when the light-sensing device 710 detects light.

In FIG. 6 to FIG. 9, a reference numeral 512 denotes a battery, and a reference numeral 513 denotes a power switch.

Next, a usage of the food and drink conveying device 5 will be described below.

Initially, when the power switch 513 is turned on, the light-sensing device 710 becomes activated and the electromagnet 840 is magnetized. Consequently, as shown in FIG. 6, the iron plate 40*b* of the plate cover 40 is attracted by and attached to the electromagnet 840, and the plate cover 40 is retained by the retaining member 8.

Figure 6:
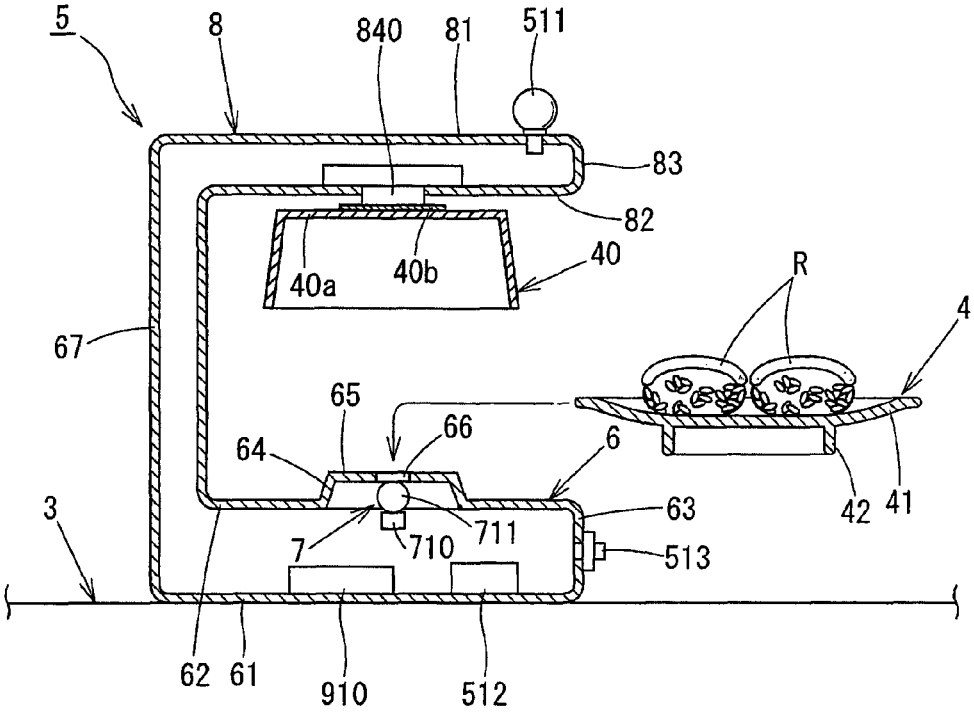
FIG. 6 is a schematic cross-sectional view of a food and drink conveying device according to another embodiment.
Figure 7:
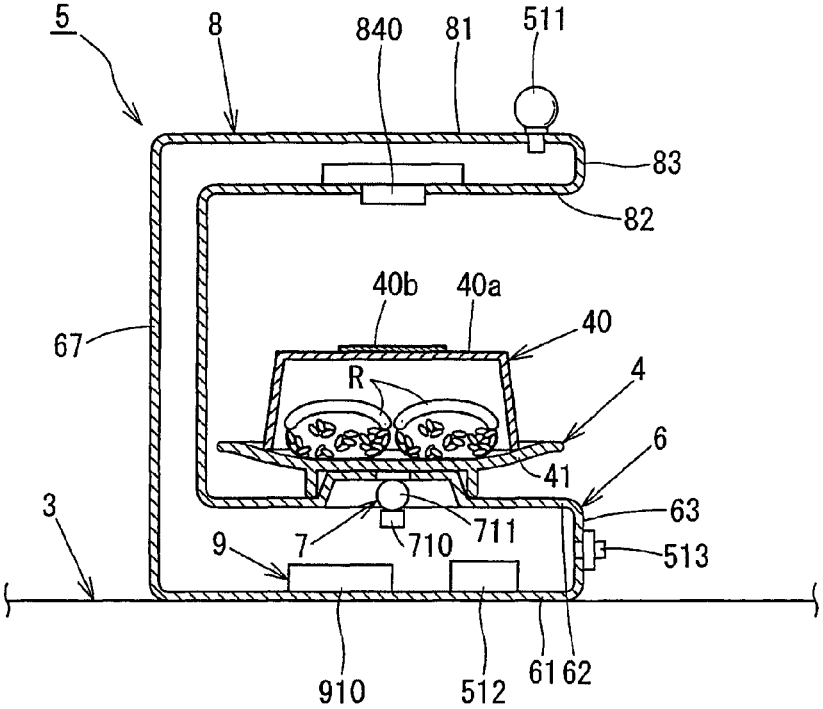
FIG. 7 is a schematic cross-sectional view of the food and drink conveying device having a plate loaded on the plate loading portion.

As shown in FIG. 6, when the plate 4 dished up with the sushi R is put on the top plate 62 of the plate loading portion 6 and the rest 42 of the plate 62 is engaged on the convexity portion 64, the detection of light by the light-sensing device 710 is stopped. In accordance therewith, the control device 910 performs control so as to stop supplying power to the electromagnet 840. When a short time has passed after that, the electromagnet 840 is demagnetized, and, as shown in FIG. 7, the plate cover 40 is dropped and put on the plate 4 so as to cover the sushi R dished up on the dish plate 41.

As described above, the sushi R covered with the plate cover 40 is conveyed together with the plate 4 on the conveyance path 3. During the conveyance, the sushi R on the plate 4 is plate covered with the plate cover 40. Therefore, a guest will not inadvertently touch the sushi R on the plate 4, and a problem that the sushi R on the plate 4 tends to become dried due to wind generated during the conveyance can be alleviated.

Figure 8:
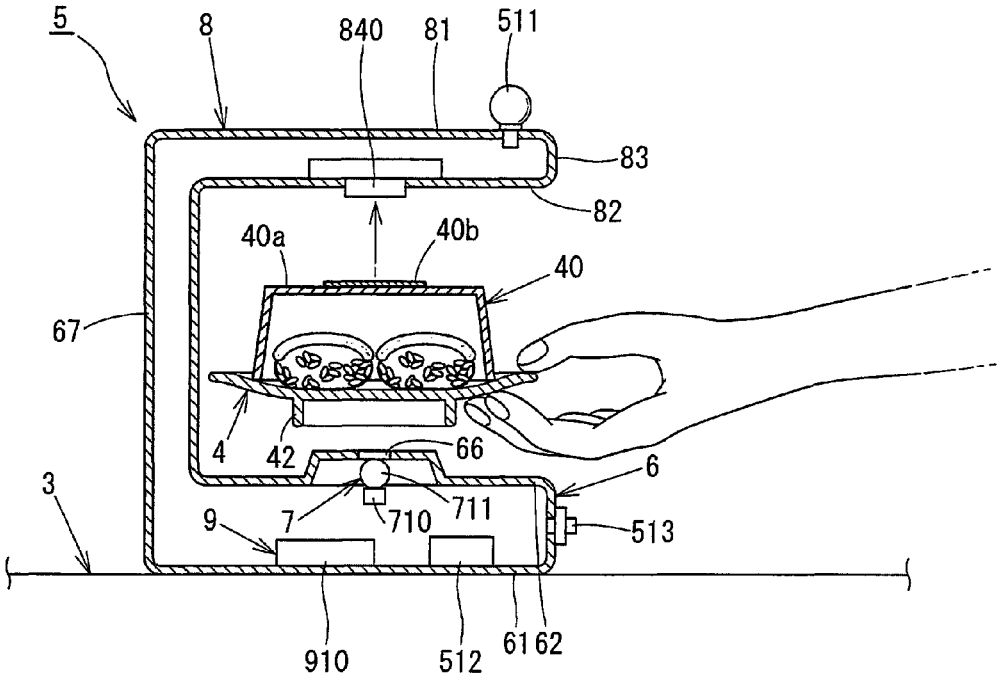
FIG. 8 is a schematic cross-sectional view of the food and drink conveying device from which a plate on the plate loading portion is being removed.
Figure 9:
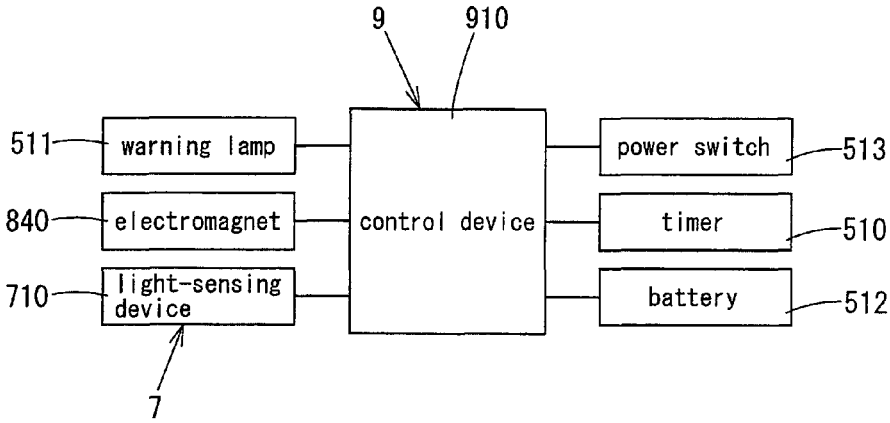
FIG. 9 is a block diagram illustrating the food and drink conveying device shown in FIG. 6.

On the other hand, when a guest takes out the plate 4 from the food and drink conveying device 5, the guest holds the edge of the dish plate 41 with his/her hand, and lifts the plate 4 upward, as shown in FIG. 8, so that the top wall 40*a* of the plate cover 40 touches the bottom surface of the lower plate 82 of the retaining member 8. By lifting the plate 4, the light-sensing device 710 detects light, and the electromagnet 840 is immediately magnetized.

Therefore, the iron plate 40*b* of the plate cover 40 is attracted by and attached to the electromagnet 840, and the plate cover 40 is retained by the retaining member 8. Therefore, only the plate 4 dished up with the sushi R can be drawn toward the guest.

When the food and drink conveying device 5 retaining the plate cover 40 on the retaining member 8 is returned to the kitchen, the plate 4 newly dished up with the sushi R can be loaded repeatedly on the plate loading portion 6 in the manner as described above.

When the food and drink conveying device 5 has the configuration as described above, a guest and a cook need not directly touch the plate cover 40 with his/her hand, and the plate cover 40 can be easily put on the plate 4 and the plate cover 40 can be easily removed from the plate 4.

Therefore, cleanliness of the plate cover 40 can be enhanced, and the plate cover 40 removed from the plate 4 is not placed on a table, unlike in the conventional art.

Further, when the plate 4 dished up with sushi R has been conveyed on the food and drink conveying device 5 and uneaten for a predetermined time period, the control device 910 controls the warning lamp 511 so as to be lit up because the timer 510 continues to be on. Therefore, even when the light-sensing device 710 detects light, the electromagnet 840 is not magnetized.

Accordingly, by lighting up the warning lamp 511, it is indicated that the sushi R on the plate 4 has been conveyed on the conveyance path 3 for a predetermined time period. Even when the plate 4 is inadvertently taken from the plate loading portion 6, the plate cover 40 is not retained by the retaining member 8, that is, the plate cover 40 is left on the plate 4. Therefore, a guest will know that the sushi R has been conveyed on the conveyance path 3 for a predetermined time period or longer.

Therefore, the food and drink conveying device 5 described above can prevent the sushi R from being inadvertently served to a guest after a predetermined time period has passed.

In the embodiment described above, the detection means 7 is configured as the light-sensing device 710. However, a limit switch may be used.

Further, in the embodiment described above, the warning lamp 511 is provided on the retaining member 8. However, the warning lamp may be replaced with a speaker capable of beeping.

What is claimed is:

1. A food and drink conveying device to be used while on a conveying apparatus, said food and drink conveying device comprising:

a plate loading portion for supporting a plate having at least one of food and drink thereon;

a detection member for detecting a presence of the plate to be supported on said plate loading portion;

a retaining member located above said loading portion, said retaining member being configured to detachably retain a plate cover; and a removal member for releasing said plate cover from said retaining member;

wherein said detection member, said retaining member, and said removal member are interconnected and configured such that when said detection member detects the presence of the plate supported on said plate loading portion, said removal member automatically releases said plate cover from said retaining member so as to allow said plate cover to drop onto the plate supported on said plate loading portion to thereby cover the plate with said plate cover;

wherein said detection member comprises a detection rod portion configured to extend upwardly from and retract downwardly into said plate loading portion, and said removal member comprises a removal rod portion configured to retract upwardly into and extend downwardly from an interior of said retaining member based on respective corresponding movement of said detection member interlocked to said removal member; and wherein said detection rod portion and said removal rod portion are configured and interconnected such that when the plate is loaded onto said plate loading portion, said detection rod portion is pressed so as to retract downwardly into said plate loading portion while said removal rod portion simultaneously extends downwardly from said retaining member so as to release said plate cover retained by said retaining member from said retaining member and thereby drop said plate cover onto the plate supported on said plate loading portion whereby the plate is covered by said plate cover.

2. The food and drink conveying device of claim 1, wherein said retaining member includes a magnet and said plate cover includes magnetic material, said retaining member and said plate cover being configured such that when said plate cover approaches said retaining member, said magnetic material of said plate cover and said magnet of said retaining member become attracted to each other by magnetic force.

3. The food and drink conveying device of claim 1, wherein said retaining member includes a magnet and said plate cover includes a magnetic material, said retaining member and said plate cover being configured such that when said plate cover approaches said retaining member, said magnetic material of said plate cover and said magnet of said retaining member become attracted to each other by magnetic force.

4. The food and drink conveying device of claim 3, wherein said magnet comprises an electromagnet, and said detection member includes a control device for sending an on/off signal to said electromagnet depending on whether said detection member has detected the presence of the plate.

5. The food and drink conveying device of claim 4, wherein said detection member further includes a light sensing device configured to determine the presence of the plate supported on said plate loading portion when less light is detected.

6. The food and drink conveying device of claim 3, wherein said magnet comprises an electromagnet, and said removal member includes a control device for sending an off signal to said electromagnet when said detection member has detected the presence of the plate so that said plate cover is released by said electromagnet of said retaining member and drops onto the plate.

* * * * *